United States Patent [19]

Dandl

[11] Patent Number: 4,733,133

[45] Date of Patent: Mar. 22, 1988

[54] METHOD AND APPARATUS FOR PRODUCING MICROWAVE RADIATION

[75] Inventor: Raphael A. Dandl, San Marcos, Calif.

[73] Assignee: Applied Microwave Plasma Concepts, Inc., Carlsbad, Calif.

[21] Appl. No.: 801,937

[22] Filed: Nov. 26, 1985

[51] Int. Cl.[4] ..... H01J 17/26; H05B 31/26

[52] U.S. Cl. ..... 315/111.41; 315/111.71; 315/4; 315/39; 313/231.31; 313/161; 376/123

[58] Field of Search ..... 315/111.81, 111.91, 315/111.41, 5, 111.71, 39.3, 4, 39; 313/231.31, 161; 330/4.3; 376/121, 123; 372/50

[56] References Cited

U.S. PATENT DOCUMENTS

| | | | |
|---|---|---|---|
| 3,872,349 | 3/1975 | Spero et al. | 315/39 |
| 4,345,220 | 8/1982 | Sullivan | 331/79 |
| 4,500,843 | 2/1985 | Szoke et al. | 330/4.3 |
| 4,506,229 | 3/1985 | Prosnitz et al. | 330/4.3 |
| 4,548,782 | 10/1985 | Manheimer et al. | 376/127 |
| 4,559,475 | 12/1985 | Manheimer et al. | 315/4 |
| 4,604,551 | 8/1986 | Noeller | 315/4 |

OTHER PUBLICATIONS

"Cyclotron Resonance Maser with Background Plasma", Sov. Phys. JETP 53(), Jun. 1981, pp. 1146–1152.

*Primary Examiner*—Leo H. Boudreau
*Assistant Examiner*—Mark R. Powell
*Attorney, Agent, or Firm*—Robert Charles Hill

[57] ABSTRACT

A method and apparatus are disclosed for producing microwave radiation wherein a generally stable, high-beta, relativistic electron plasma is formed and magnetically confined in a magnetic mirror region of a suitable enclosure, a convectively unstable wave then being created in the confined plasma for producing a pulse of relatively intense microwave radiation at a frequency near a local electron gyrofrequency of the plasma, the plasma preferably being formed by simultaneous multiple-frequency electron cyclotron heating and upper off-resonant heating using microwave power at frequencies above the electron gyrofrequency of the plasma. The above steps or functions are preferably sequentially repeated with sequential pulses of microwave radiation being withdrawn from the enclosure, focused by quasi-optical means and directed toward a target including electronic circuitry, the method and apparatus of the invention being preferably adapted for causing the beam of sequential pulses to be coupled into the electronic circuitry for developing substantial amounts of energy therein.

34 Claims, 3 Drawing Figures

METHOD AND APPARATUS FOR PRODUCING MICROWAVE RADIATION

FIELD OF THE INVENTION

The present invention relates to a method and apparatus for producing microwave radiation and more particularly to such a method and apparatus for producing high-power, pulsed, microwave radiation within apparatus such as a pulsed microwave source including a suitable enclosure having a magnetic field, at least one magnetic mirror region, a source of neutral gas to be ionized, and a relatively low-power, steady-state source of microwave power for generating and sustaining an energetic-electron plasma using electron cyclotron heating.

BACKGROUND OF THE INVENTION

Great amounts of effort have been expended in the prior art in connection with magnetic confinement of plasma for example in controlled thermonuclear fusion devices and the like. In this connection, the plasma comprises a highly ionized gas composed of a nearly equal number of positive and negative free charges (or positive ions and electrons). Because of the mutually coupled nature of electromagnetic fields within such a plasma and the motion of the plasma charges themselves, it has been well documented that the plasma can support unusual oscillations and wave motions, both stable and unstable. For example, stable and unstable wave motions in plasma are described by the McGraw-Hill Encyclopedia of Science & Technology, particularly in Volume 10, at pages 443–461 and Volume 14 at pages 501–507, both of the above noted volumes being published by McGraw Hill Inc., 1977.

Further prior art work has been carried out in these areas having a closer relation to the method and apparatus of the present invention. A number of these prior art reference are briefly described below.

(1) Initially, work in connection with high-beta, hot-electron plasmas produced by electron-cyclotron heating was disclosed in an article entitled "Impact of Multiple-Frequency Heating on the Formation and Control of Diamagnetic Electron Rings in an Axisymmetric Mirror", Phys. Fluids, 28 (5), May 1985.

(2) Resonant healing by microwave power for producing high-beta plasma with electron temperatures near one MeV was discussed in an article entitled "Off-Resonance Effects on Electrons in Mirror-Contained Plasmas", Nuclear Fusion, 11 (1971).

(3a) Work extending the results of a previous investigation of growing electromagnetic waves in a gyrotropic electron plasma to relativistic-electron energies was set forth in an article entitled "Electromagnetic Instabilities in the Non-Thermal Relativistic Plasma", Phys. Fluids, 6, 57 (1963).

(3b) Related work concerning a governing equation for whistler modes in the Elmo Bumpy Torus is set forth in an article entitled "Whistler Instability in the Elmo Bumpy Torus", Phys. Fluids, 25 (4), Apr. 1982.

(4) Production of a hot electron plasma in a magnetic-mirror field by high-power microwave discharges was disclosed in an article entitled "Microwave Burst at Triggered Instability in a Hot Electron Plasma", Phys. Fluids, 11 (5), May 1968.

(5) The effects of a relativistic electron population of the temporal and spatial growth rates of the whistler instability were described in an article entitled "The Whistler Instability at Relativistic Energies", Phys. Fluids, 26 (4), Apr. 1983.

(6) Further work in the area of unstable electromagnetic waves similar to whistler modes was disclosed in an article entitled "Electromagnetic Ion Cyclotron Instability Driven By Ion Energy Anisotropy In High-Beta Plasmas", Phys. Fluids, 18, 1045 (1975).

(7) Additional work concerning the ability of magnetically confined plasmas created and heated by electromagnetic fields near the electron gyrofrequency to support wave instability was disclosed in an article entitled "Stability of Microwave-Heated Plasmas", Nuclear Fusion 11 (1971).

Rather than repeating substantial background information provided for example by the above references, each of the above references is incorporated herein as though set out in its entirety.

Generally, prior art references such as those noted above have dealt with the use of conventional sources of microwave energy to create and sustain magnetically confined plasmas for a variety of applications, together with an identification of the instabilities that can occur in such plasmas. However, there has generally been found to remain a need for a method and apparatus for generating microwave energy at high power levels substantially greater than those contemplated in the prior art while adapting the form of the high-power microwave energy for a number of different applications.

SUMMARY OF THE INVENTION

It is therefore an object of the present invention to provide a method and apparatus for producing pulses of high-power microwave radiation within an enclosure having a magnetic field, at least one magnetic-mirror region and a source of neutral gas to be ionized, the method and apparatus comprising the development of a selected gas pressure within the enclosure, the generation of the magnetic field at a strength suitable for causing electron cyclotron heating, the introduction of high frequency microwave energy of a selected frequency and power level into the magnetic mirror region, the electron cyclotron heating thereafter being continued for forming a generally stable, high-beta, relativistic-electron plasma in the enclosure, a controlled wave instability then being induced in the plasma for producing a pulse of relatively intense microwave radiation at a frequency near a local electron gyrofrequency of the plasma.

The method and apparatus of the present invention preferably contemplate such a combination wherein electron cyclotron heating is carried out by simultaneously employing multiple-frequency electron cyclotron heating and upper off-resonant heating using microwave power at frequencies above the electron gyrofrequency of the plasma for preferentially heating the relativistic-electron plasma whereby both plasma stability and stored energy in the plasma are greatly enhanced.

It is further contemplated within the method and apparatus of the present invention that the high-power microwave radiation formed within the enclosure be withdrawn from the enclosure through focusing means for concentrating sequential microwave pulses into a beam of focused radiation and directing the beam onto a remote target for concentrating energy therein. Preferably, the method and apparatus is adapted for directing the beam toward a target including electronic circuit means and conditioning the beam so that it is coupled into the electronic circuit means for developing substantial amounts of energy in the target.

In view of the preceding objects, the method and apparatus of the present invention includes obvious potential for destroying or rendering inoperable electronic controls essential for example in offensive weapons systems. Suitable target applications of this type include boost and post-boost vehicles, collateral action on sensors and communications systems as well as satellite-based systems. The present invention contemplates a method and apparatus for effectively concentrating energy in such targets through the development of high-power microwave pulses with very rapid rise times and frequencies corresponding to characteristic operating frequencies of the target system.

Such operating frequencies are at very high levels and are expected to be at even higher levels in future generation devices. In prior art sources of microwave power, the maximum emitted power decreases rapidly with increasing frequency, principally because the size of a resonant structure decreases with increasing frequency while the power density increases with frequency to unacceptable levels. Thus, high-power microwave energy is now generally available only at frequencies that are well below the characteristic frequencies of many such systems. Under these conditions, coupling is primarily through apertures not intended for microwave propagation, with efficiency being consequently much less than achieved by direct coupling.

The importance of such applications and the limitations inherent in present microwave sources underline the urgent need for method and apparatus such as provided by the present invention for preferably producing pulsed, high-power microwave energy, with power levels above $10^{12}$ Watts for example at frequencies greater than eighteen gigahertz (GHz) and more preferably for generating short repetitive pulses of microwave power at levels in the range of about $10^{10}$–$10^{14}$ watts with frequencies above about 35 GHz.

Prior art microwave sources have also been found to exhibit a "resonant structure" problem in the form of unfavorable frequency dependence of peak power because the size of their interaction region is proportional to the wave length emitted. Moreover, electron energy or beams used in existing devices must generally operate at high voltages to ameliorate or overcome the space-charge effects that degrade source performance.

The present invention circumvents conventional resonant-structure problems and space-charged limitations by using microwave energy stored in a magnetically-confined, electrically neutral, relativistic-electron plasma, rather than an electron beam. The stored energy is built up over a period of seconds, for example, by electron cyclotron heating using moderate steady-state levels of microwave power, available from existing sources. Part of this stored energy is transformed into a pulse of microwave radiation in times less than one microsecond, for example, resulting in a peak power that is correspondingly larger than the electron cyclotron heating power.

Because of the temporal compression brought about by the sudden transformation of energy built up much more slowly, very high-power pulses can be produced repetitively from much lower power, steady-state microwave sources operating in the frequency range required for the particular application. The peak power that can be achieved increases with frequency and with the volume of the magnetic-mirror configuration used to confine the relativistic-electron plasma. This permits very favorable scaling for applications of the type described above as described in greater detail below.

The method and apparatus of the invention employ a confining magnetic field forming an elongated, cylindrical, axisymmetric, magnetic-mirror region that is constricted at one or more axial positions inside its plane of reflection symmetry by additional, axisymmetric magnetic coils. Upon initiation of an operating cycle, the magnetic field preferably has the form of two or more co-linear magnetic mirrors, formed inside a conducting shell that serves as a vacuum chamber and as an enclosure for microwave power.

Gas pressure within the chamber is reduced to an appropriate level (about $10^{-5}$ Torr), the magnetic intensity is raised to a pre-selected level (about 2 Tesla) and microwave power at the electron cyclotron frequency is introduced into the chamber at high enough power (about 1 Watt/cm$^3$) to create a relativistic-electron plasma with a beta value approaching unity. Beta is the ratio of plasma pressure, p, to magnetic energy density, $B^2/2\,\mu_o$, where B is the magnetic field strength and $\mu_o$ is the magnetic permeability of free space. Beta is a dimensionless measure of the energy density stored in the plasma.

Advanced electron cyclotron heating techniques yield a stable, high-beta, hot-electron plasma in the form of two or more separate annular rings located in the co-linear mirror regions. The plasmas are below the threshold for unstable growth of a class of electromagnetic waves propagating along field lines, such as whistlers, by virtue of their broad distribution of electrons in relativistic energies and the spatial variation of magnetic intensity, together with moderate pressure anisotropy, controlled by the heating process.

In a second phase of operation, auxiliary magnetic coils, for example, are energized to alter the spatial shape of the magnetic field into a single elongated magnetic mirror with a nearly uniform central region. This alteration is accomplished in a time that is much shorter than the hot-electron confinement time, resulting in adiabatic compression and merger of the separate annular rings of plasma formed in the first phase. This adiabatic compression increases both the pressure anisotropy and the magnetic field uniformity, bringing the hot-electron plasma to the threshold for unstable growth of the desired plasma waves.

A short pulse of microwave power is then injected to initiate an unstable wave, such as the whistler, and to create a denser cold plasma at the ends of the hot-electron plasma. The whistler is internally reflected by this surface layer of cold plasma and grows to its saturated amplitude before the cold plasma has dissipated and the whistler can escape along the magnetic field lines. The growth of the whistler results from a transfer of stored energy from the plasmas into microwave energy in the oscillating fields of the whistler wave. Whistlers propagate within a narrow cone centered on the magnetic field line and can thus be guided magnetically into a quasi-optical structure that focuses the microwave power into a beam.

At the end of the high-power pulse, the auxiliary magnetic coils used for adiabatic compression are switched off and the magnetic field relaxes to its initial form. The operating cycle is then repeated to form sequential pulses of microwave energy.

There are several important features of the present invention. In the initial phase, it is essential for efficient creation of stable, high-beta, hot-electron plasmas to use two advanced electron cylotron heating techniques; namely, multiple-frequency electron cyclotron heating (MFECH) and upper off-resonant heating (UORH). MFECH uses microwave power at several different but closely-spaced frequencies to enhance the efficiency of creating relativistic-electron plasmas; improvement of almost an order of magnitude is achieved with this technique. UORH uses microwave power at frequencies above the electron gyrofrequency to heat relativistic electrons preferentially; plasma stability as well as stored energy are greatly enhanced with this technique.

The use of adiabatic compression of the plasma in an equilibrium condition to bring the plasma to the threshold for unstable growth of plasma waves is based on the identification of pressure anisotropy and magnetic field uniformity as the most effective control parameters for this mode. This identification is supported by a large number of theoretical studies of unstable electromagnetic waves (such as whistlers) as well as the closely related Alfven Ion Cyclotron mode. Adiabatic compression increases the perpendicular velocity of emergetic electrons preferentially, thereby increasing the perpendicular pressure relative to the parallel pressure. The particular type of adiabatic compression used in the present invention has the added beneficial effect of bringing most of the plasma into a uniform magnetic field region and maximizing the fraction of the stored energy that is transformed into microwave power.

Finally, the use of a transient cold-plasma layer to reflect the growing whistlers is analagous to Q-switching in conventional lasers. The objective is to further maximize the conversion of stored plasma energy to microwave power.

Additional objects and advantages of the invention will be apparent from the following description having reference to the accompanying drawings.

DESCRIPTION OF THE PREFERRED EMBODIMENT

As discussed above, the present invention provides a method and apparatus for efficiently storing substantial energy densities in high-beta, hot-electron plasmas, created and sustained by electron cyclotron heating (ECH) in a suitable magnetic mirror device. A large fraction of this energy can be released in a short time by triggering suitable plasma instabilities such as unstable whistler waves driven by excess pressure anisotropy. Useful collective modes with frequencies at about the electron gyrofrequency and linear growth rates that are a significant fraction of the electron gyrofrequency can be stimulated by proper design of the ECH and magnetic systems within the invention. Under suitable circumstances, it is anticipated that the method and apparatus of the invention are capable of generating relatively short pulses of microwave power, for example, at levels in the range from about $10^{10}$–$10^{14}$ Watts, at frequencies above 35 GHz, and with repetitive or sequential rates greater than one per second.

Thus, the method and apparatus of the invention are believed to have utility in a number of applications employing high-power microwave radiation developed in a magnetic mirror device and preferably transferred from the device through a focusing means to produce a pulsed beam of microwave radiation. This aspect of the invention makes possible the generation of high-power microwave beams which can be directed at remote target systems.

Figure 1:
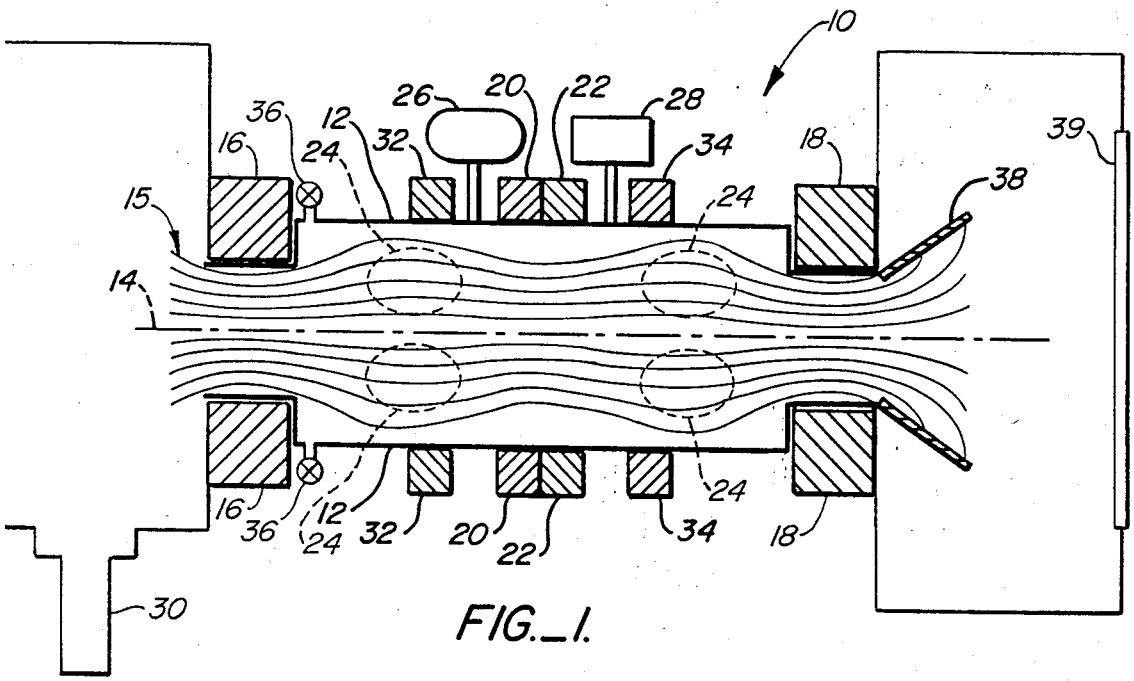
FIG. 1 is a generally schematic representation of a device comprising a magnetic mirror region enclosure for magnetically confining a plasma in accordance with the present invention.
Figure 2:
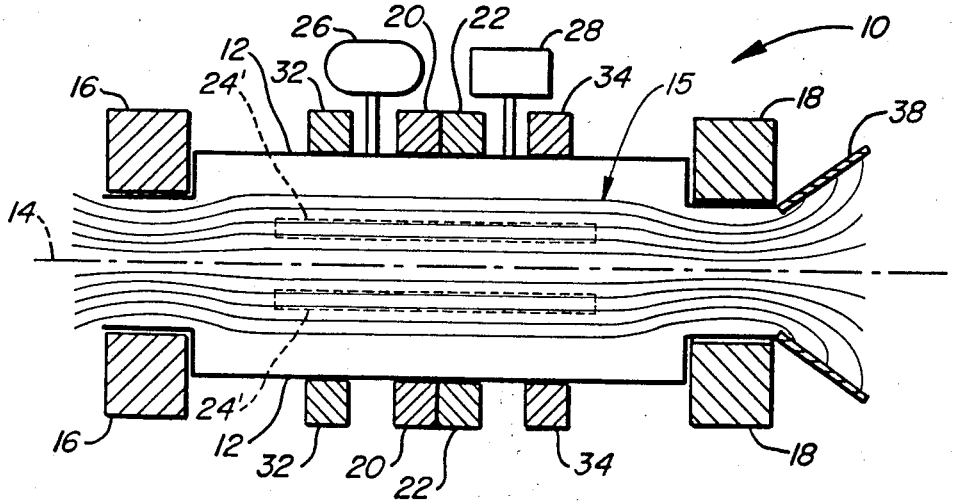
FIG. 2 is a view of the same device as illustrated in FIG. 1 but in a second operating stage described in greater detail below for introducing an unstable wave into the confined plasma.

Referring to the drawings and particularly to FIG. 1, a magnetic-mirror device of the type suitable for use within the present invention is generally indicated at 10. The device 10 includes a suitable elongated vacuum enclosure 12 having an axis of symmetry 14. Primary magnetic-mirror coils 16 and 18 are arranged in coaxial relation at opposite ends of the enclosure 12. Additional magnetic-mirror coils 20 and 22 are also arranged in coaxial relation with each other and with the primary coils 16 and 18. The additional coils 20 and 22 are arranged adjacent the longitudinal center of the enclosure 12 while being operable in a generally conventional fashion for forming two identical magnetic-mirror regions 24 as indicated in FIG. 2.

The device 10 also includes a source 26 of a suitable neutral gas for forming a plasma within the enclosure 12 and more particularly within the magnetic-mirror regions 24. The device 10 also includes a microwave source 28 adapted for developing both multiple-frequency electron cyclotron heating (MFECH) and upper off-resonant heating (UORH) within the enclosure 12 and also particularly within the magnetic-mirror regions 24. One or more vacuum pumps 30 is also provided for developing suitable evacuated pressures within the enclosure 12.

Auxiliary magnetic coils 32 and 34 are also arranged in coaxial relation with each other and with the primary coils 16, 18 and additional coils 20, 22. Furthermore, the auxiliary magnetic coils 32 and 34 are respectively arranged intermediately between adjacent pairs of the primary coils 16, 18 and additional coils 20, 22 for operation in a manner described in greater detail below for selectively compressing magnetic lines of force 15 about the magnetic-mirror regions 24 in accordance with the present invention.

Fast-acting valves 36 are arranged preferably adjacent one end of the enclosure 12, as illustrated in FIG. 1, for injecting suitably timed pulses of neutral gas into the enclosure also in accordance with the present invention for a purpose discussed in greater detail below.

Figure 3:
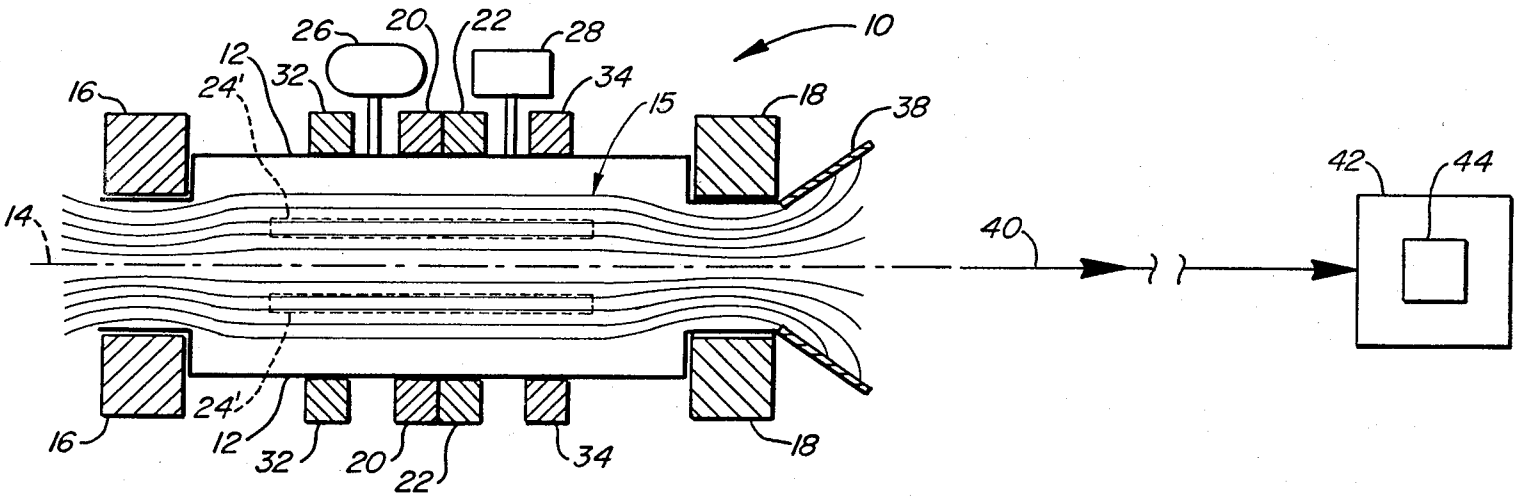
FIG. 3 is a schematic representation of the same device while illustrating additional components for causing a focused beam of microwave energy to be directed toward a remote target.

Microwave energy developed within the device 10 is withdrawn by means of a quasi-optical structure 38 for producing a focused beam 40 of radiation which can be directed toward a remote target 42 through a suitable vacuum window 39 as illustrated in FIGS. 1 and 3. The remote target 42 is preferably of a type including electronic circuitry or an electronic subsystem 44, the method and apparatus of the invention being adapted as described in greater detail below for directly coupling microwave energy into the electronic subsystem 44 for developing substantial amounts of energy therein.

The apparatus of the present invention as described above and a corresponding method, described in greater detail below, make possible a substantial advance in the development of microwave energy. In this regard, prior art devices for the production of high-power microwave energy exhibit a systematic reduction in power with increasing operating frequency because the size of the interaction region is proportional to the wave length. This severely limits the average and peak powers which can be generated. A notable exception to the scaling of interaction region size with frequency is the Free Electron Laser in which relativistic contraction maintains a constant interaction size. The efficiency decreases, however, as the frequency increases for all electron beam devices. Coupled with this is the inherent requirement for high voltage to minimize space charge effects in the electron beam which can significantly alter electron distribution and therefore performance of the system.

By contrast, the method and apparatus of the present invention circumvent conventional resonant structure problems and space charge limitations by storing microwave energy directly in a magnetically trapped, electrically neutral relativistic-electron plasma, thereby achieving the capability of producing very high power microwave pulses.

Prior art devices of the type referred to above also tend to provide peak output power at low frequencies where the dominant coupling mechanism to a target is achieved primarily by "back door coupling", that is, coupling through holes or apertures of the target in a manner not particularly suitable for microwave propagation. By contrast, the present invention permits the development of very high-power, fast real-time signals which follow direct coupling paths to the target and particularly to the internal electronics for generating very substantial amounts of energy therein. In this application of the invention, the development of high-power, high-frequency devices capable of operating in the frequency band of target operating systems is critical, particularly because of the likelihood for successive generation devices to operate at still higher frequencies. Thus, the present invention makes possible the generation of substantial amounts of energy even at these increased frequencies.

In achieving the objective noted above, the method and apparatus of the present invention provide a unique high performance microwave source capable of operation in a parameter regime of substantially increased frequency and power levels. As noted above, the method and apparatus of the invention provide a novel means for efficiently storing energy by magnetic confinement of relativistic-electron plasma. The conversion of this stored energy by the triggering of a convectively unstable wave, for example a relativistic whistler instability, and the subsequent collection and focusing of the microwave radiation result in a system offering significant advantages over existing concepts.

The build-up and confinement of the relativistic-electron plasma occurs over a time scale of seconds. The transformation of this energy into a high peak power pulse occurs in less than one microsecond, for example, resulting in an effective temporal compression.

Successful operation of the invention indicates that the corresponding concept can be extended to yield dramatically high energy levels. For example, it is contemplated that energy in the range of between five and ten kilojoules can be achieved in the electron distribution by producing a hot-electron plasma with a density greater than $1\times10^{12}$ electrons/cubic centimeters ($E/cm^3$) with a temperature of about one million electron volts in a volume of seventy thousand cubic centimeters. The ability to produce this condition in a collision-free plasma where the limiting effects of space-charge are not present offers the possibility of scaling to drastically increased energy levels, offering a new conceptual approach to the production of high-power microwave energy.

To permit a better understanding of the potential of the present invention, a relatively brief discussion is set forth below concerning the derivation of scaling laws forming a part of the present invention. These laws describe how the invention can be scaled to higher power and/or higher frequency operation.

The scaling laws of the concept derive from a number of fundamental properties of the high beta, hot-electron plasma and instability mechanism. The maximum energy density that can be stored by ECH appears to be determined by the limit that the plasma pressure be somewhat less than the magnetostatic pressure, i.e., beta can approach unity. Since the ECH sources as well as the output frequency are governed by the magnetic field strength, it is convenient to scale the physical size of the magnetic configuration to achieve the desired magnitude of energy storage, W. For higher operating frequencies the magnetic field is increased which results in both an increased electron cyclotron frequency and an increase in the allowed stored energy per unit volume (i.e. higher power outputs). The required ECH input power, P, is then determined by the confinement time of the relativistic-electron plasma, $\tau_{conf}$:

$$P_{in}=W/(E_{ech}\tau_{conf})$$

where $E_{ech}$ corresponds to the overall heating efficiency. The output power is determined by the fraction of the stored energy that is transformed into microwave radiation, $E_{erf}$ and the duration of the pulse, $\tau_{pulse}$:

$$P_{out}=\frac{\epsilon_{trf}W}{\tau_{pulse}}\,\epsilon_{trf}\,\epsilon_{ech}\,\tau_{conf}\,P_{in}/\tau_{pulse}$$

Under typical ECH conditions, $\tau_{conf}\sim1$ sec. Pulse lengths appear to be given in order of magnitude by hundreds of electron gyroperiods, $\tau_{pulse}\sim10^2/f_\mu\sim10^{-8}$ sec. Thus, the ratio of the output power to the ECH input power can be very large:

$$P_{out}/P_{in}=\epsilon_{trf}\epsilon_{ech}\tau_{conf}/\tau_{pulse}\sim10^8\epsilon_{trf}\epsilon_{ech}$$

Since typical ECH input power densities are in the range 0.1–1 Watt/$cm^3$, this concept offers the potential for output power densities of $10^6$Watt/$cm^3$. For the device envisioned as an overall system demonstration of this concept, 10kJ is created and sustained by 10's of kW ECH power in a volume of less than 1 $m^3$, yielding output powers in excess of $10^{10}$ W.

The method of operation of the apparatus illustrated in FIGS. 1–3 is believed apparent from the preceding description of the apparatus and the theoretical discussion. However, operation is briefly described below in order to assure a complete understanding of the invention.

In operation, vacuum conditions are developed within the enclosure 12 by the vacuum pump 30 after which a suitable amount of an appropriate gas is introduced into the enclosure from the source 26.

The primary and additional magnetic-mirror coils 16, 18 and 20, 22 are operated for developing the magnetic-mirror regions 24 within the enclosure 12.

Microwave energy is introduced into the enclosure from the source 28 for achieving both multiple-frequency electron cyclotron heating (MFECH) and upper off-resonant heating (UORH) within the enclosure and particularly within the magnetic-mirror regions 24. At the same time, neutral gas pressure within the enclosure 12 is maintained at an optimum operating value by controlling the flux of input gas and evacuating the enclosure by means of the pump 30.

As noted above, both above noted modes of electron cycloton heating, namely MFECH and UORH, are employed within the present invention. In MFECH, heating power is applied at several different but closely spaced frequencies near the gyrofrequency of non-relativistic electrons in the plasma. In this manner, stored energy within the plasma is greatly increased relative to the amount of energy storage possible by single-frequency ECH at the same total input power. At the same time, the amount of energy stored in the relativistic-electron component of the plasma is further increased by UORH wherein additional heating power is applied at frequencies exceeding the electron gyrofrequency such that damping occurs only at the electron cyclotron harmonics. This technique preferentially heats the energetic electrons and produces an order-of-magnitude increase in the amount of stored energy made possible by the present invention. With the simultaneous employment of MFECH and UORH, a stable, high-beta, relativistic-electron plasma is efficiently developed within the magnetic-mirror regions 24 within a few seconds, for example, and can be sustained as long as ECH power is maintained in the device at a level determined by the weak, classical processes by which electrons lose energy.

A substantial fraction of the energy stored in the relativistic-electron plasma is transformed into a short pulse of intense microwave radiation at a frequency near the local electron gyrofrequency through the action of unstable coherent plasma waves. At a preselected time, the onset of suitable plasma oscillations is controlled by changing the plasma and magnetic field configuration to bring the plasma near to the threshold for spontaneous growth for a collective mode of oscillation.

The whistler mode is especially attractive for efficient conversion of stored energy to microwave fields because of the ability to control plasma parameters such as plasma pressure anisotropy and magnetic field homogeneity which governed the onset of instability conditions.

Referring to the drawings, the auxiliary magnetic coils 32 and 34 are energized in order to compress magnetic lines of force forming the magnetic-mirror regions 24 in order to form a field which is almost uniform as indicated at 24'. Annular rings of plasma within the regions 24 are compressed and coalesce to form an extended, hollow annulus of plasma in a nearly uniform magnetic field.

A short pulse of microwave power is supplied to the plasma in order to initiate instability, for example, the growth of unstable whistler waves. The build up of the unstable whistler wave to a large amplitude is further enhanced by the simultaneous generation of a dense layer of cold plasma at the axial surface of the relativistic-electron plasma adjacent the primary coils 16. As noted above, this layer of cold plasma results from the injection of suitably timed pulses of neutral gas through the valve 36.

The rapidly growing plasma wave transforms a substantial fraction of energy stored in the plasma into coherent radiation at frequencies slightly below the electron gyrofrequency. The convectively amplified whistler waves propagate along the magnetic field lines of the regions 24 into the quasi-optical structure 38. The microwave energy in the form of the amplified whistler waves continues to be focused into a radiation beam pulse until the anisotropy and beta condition of the plasma are reduced below the threshold for growth. At that time, the auxiliary coils 32 and 34 are deactuated and the magnetic field is allowed to relax to its initial magnetic-mirror configuration as illustrated in the drawings.

Thereafter, the above noted operating cycle is sequentially repeated in order to produce sequential amplified whistler waves in the enclosure 12 forming sequential pulses in the beam 40 for transfer to the target 42 in the manner described above.

"Threshold for growth" defines plasma conditions such that more energy is transferred to the wave by the plasma than is absorbed from the wave by the plasma.

The term "local electron gyrofrequency" is further defined as eB/m, where c and m are the electrical charge and mass of the electron and B is the intensity of the magnetic field.

Thus, there have been described two embodiments of apparatus and a method of operation for those embodiments in accordance with the present invention. Numerous modifications and variations are possible in addition to those set forth above. Accordingly, the scope of the present invention is defined only by the following appended claims.

What is claimed is:

1. A method for producing pulses of high-power microwave radiation within an enclosure having a magnetic field, at least one magnetic mirror region, and a source of neutral gas to be ionized, comprising the steps of developing a selected gas pressure within the enclosure, generating the magnetic field at a strength suitable for causing electron cyclotron heating, introducing high frequency microwave energy of a selected frequency and power level into the magnetic mirror region, continuing electron cyclotron heating to form a generally stable, high-beta, relativistic electron plasma in the enclosure, and then inducing a convectively unstable wave into the plasma for producing a pulse of relatively intense microwave radiation at a frequency near a local electron gyrofrequency of the plasma.

2. The method of claim 1 wherein the step of electron cyclotron heating is carried out by simultaneously employing multiple-frequency electron cyclotron heating using microwave power at multiple, closely spaced frequencies to enhance the efficiency of creating the relativistic-electron plasma and upper off-resonant heating using microwave power at frequencies above the electron gyrofrequency for preferentially heating the relativistic-electron plasma whereby both plasma stability and stored energy in the plasma are greatly enhanced.

3. The method of claim 1 wherein the step of inducing a convectively unstable wave into the plasma is carried out by first adiabatically compressing the magnetically confined plasma for perferentially increasing perpendicular velocity of energetic electrons within the plasma and thereby increasing perpendicular pressure in the plasma relative to parallel pressure in order to bring a substantial portion of the plasma into a uniform magnetic field region and to maximize transformation of stored energy into microwave pulse power.

4. The method of claim 3 wherein the step of adiabatic compression is simultaneously accompanied with field shaping of the magnetically confined plasma by supplemental magnet means for bringing the plasma equilibrium close to the threshold for whistler instability.

5. The method of claim 4 wherein multiple magnetic mirror regions are formed within the enclosure by coaxially arranged magnetic coils.

6. The method of claim 1 wherein the step of inducing a convectively unstable wave in the plasma is carried out for producing unstable whistler waves within the plasma.

7. The method of claim 6 wherein the step of inducing a convectively unstable wave in the plasma further comprises producing of a transient cold-plasma layer in a peripheral portion of the magnetically confined plasma for reflecting growing whistler waves, thereby further maximizing conversion of stored plasma energy into microwave power.

8. The method of claim 1 wherein multiple magnetic mirror regions are formed within the enclosure by coaxially arranged magnetic coils.

9. The method of claim 1 further comprising the step of withdrawing the relatively intense microwave pulse from the enclosure through focusing means for concentrating the pulse into a beam of focused radiation.

10. The method of claim 9 wherein the focusing means comprises a quasi-optical structure for receiving the microwave pulse from the enclosure and for transmitting the beam.

11. The method of claim 9 wherein the prior steps of the method are sequentially repeated for producing a sequential output series of pulses in the beam.

12. The method of claim 1 wherein the prior steps are sequentially repeated for producing a sequential output series of microwave pulses.

13. The method of claim 12 wherein the step of inducing a convectively unstable wave is performed after electron-cyclotron heating has been continued for placing the generally stable, high-beta, relativistic electron plasma in a condition above its threshold for growth, the resulting pulse of radiation continuing until the anisotropy and beta condition of the plasma are reduced below its threshold for growth.

14. The method of claim 13 wherein the step of inducing the convectively unstable wave is carried out by actuation of auxiliary magnetic coils arranged in the enclosure in coaxial relation with the magnetically confined plasma, the auxiliary magnetic coils being deactuated after the pulse of radiation is reduced below the threshold for growth of the plasma in order to allow the magnetically confined plasma to relax to its initial mirror configuration.

15. The method of claim 12 further comprising the step of withdrawing the sequential output series of microwave pulses from the enclosure through focusing means for concentrating the pulse into a beam of focused radiation.

16. The method of claim 15 wherein the focusing means comprises a quasi-optical structure for receiving the microwave pulse from the enclosure and for transmitting the beam of focused radiation.

17. The method of claim 15 further comprising the step of directing the beam of focused radiation toward a target including electronic circuit means, the prior steps being selectively carried out for causing the beam to be directly coupled into the electronic circuit means for developing substantial amounts of energy therein.

18. A method of producing microwave radiation, comprising the steps of (a) forming a generally stable, high-beta relativistic-electron plasma magnetically confined in a magnetic mirror region of an enclosure, (b) inducing a convectively unstable wave in the confined plasma for producing a pulse of relatively intense microwave radiation at a frequency near a local electron gyrofrequency of the plasma, (c) withdrawing the relatively intense microwave radiation pulse from the enclosure through focusing means for concentrating the radiation pulse into a beam of focused radiation, (d) sequentially repeating steps (a), (b) and (c) to produce a beam of sequential pulses, and (e) directing the beam of sequential pulses toward a target including electronic circuit means, steps (a), (b) and (c) being selectively carried out for causing the beam of sequential pulses to be coupled into the electronic circuit means for developing substantial amounts of energy therein.

19. The method of claim 18 wherein the step of forming the generally stable, high-beta, relativistic-electron plasma is carried out by means of electron cyclotron heating comprising simultaneous use of multiple-frequency electron cycloton heating using microwave power at multiple, closely spaced frequencies to enhance the efficiency of creating the relativistic-electron plasma and upper off-resonant heating using microwave power at frequencies above the electron gyrofrequency for preferentially heating the relativistic-electron plasma whereby both plasma stability and stored energy in the plasma are greatly enhanced.

20. The method of claim 18 wherein the step of inducing a convectively unstable wave in the plasma is carried out by adiabatically compressing the magnetically confined plasma for preferentially increasing perpendicular velocity of energetic electrons within the plasma and thereby increasing perpendicular pressure in the plasma relative to parallel pressure in order to bring a substantial portion of the plasma into a uniform magnetic field region and to maximize transformation of stored energy into microwave pulse power.

21. The method of claim 20 wherein the step of adiabatic compression is simultaneously accompanied with field shaping of the magnetically confined plasma by supplemental magnet means for bringing the plasma equilibrium close to the threshold for whistler instability.

22. The method of claim 21 wherein the plasma is confined within a magnetic mirror region of an enclosure, the magnetic mirror region being formed by coaxially arranged magnetic coils.

23. The method of claim 18 wherein the step of inducing a convectively unstable wave in the plasma is carried out for producing whistler waves of instability within the plasma.

24. The method of claim 23 wherein the step of inducing a convectively unstable wave in the plasma further comprises the producing of a transient cold-plasma layer in a peripheral portion of the magnetically confined plasma for reflecting growing whistler waves, thereby further maximizing conversion of stored plasma energy into microwave power.

25. The method of claim 18 further comprising the steps of employing electron cyclotron heating during formation of the confined plasma, the electron cyclotron heating being continued for placing the generally stable, high-beta, relativistic-electron plasma in a condition above its threshold for growth inducing a convectively unstable wave in the confined plasma for producing a resulting pulse of relatively intense microwave radiation, the resulting pulse of radiation continuing until the anisotropy and beta condition of the plasma are reduced below its threshold for growth.

26. The method of claim 25 wherein the step of inducing a convectively unstable wave is carried out by actuation of auxiliary magnetic coils arranged in coaxial relation with an axis of the magnetically confined plasma, the auxiliary magnetic coils being deactuated after the pulse of radiation is reduced below the threshold for growth of the plasma in order to allow the magnetically confined plasma to relax to its initial mirror configuration, and then sequentially repeating the prior steps for producing sequential pulses of relatively intense microwave radiation for transformation into the sequential pulse beam.

27. Apparatus for producing pulses of high power microwave radiation, comprising an enclosure having a magnetic field, at least one magnetic mirror region and a source of neutral gas to be ionized, means for developing a selected gas pressure within the enclosure, means for generating the magnetic field at a strength suitable for causing electron cyclotron heating, means for introducing high frequency microwave energy of a selected frequency and power level into the magnetic mirror region, the generating means being adapted for continuing electron cyclotron heating to form a generally stable, high-beta, relativistic-electron plasma in the enclosure, and means for introducing a convectively unstable wave in the plasma for producing a pulse of relatively intense microwave radiation at a frequency near a local electron gyrofrequency of the plasma.

28. The apparatus of claim 27 wherein the generating means comprises means for simultaneously performing multiple-frequency electron cyclotron heating using microwave power at multiple, closely spaced frequencies to enhance the efficiency of creating the relativistic-electron plasma and upper off-resonant heating using microwave power at frequencies above the electron gyrofrequency for preferentially heating the relativistic-electron plasma whereby both plasma stability and stored energy in the plasma are greatly enhanced.

29. The apparatus of claim 27 wherein the inducing means comprises means for adiabatically compressing the magnetically confined plasma for preferentially increasing perpendicular velocity of energetic electrons within the plasma and thereby increasing perpendicular pressure in the plasma relative to parallel pressure in order to bring a substantial portion of the plasma into a uniform magnetic field region and to maximize transformation of stored energy into microwave pulse power.

30. The apparatus of claim 29 further comprising supplemental magnet means adapted for simultaneous operation with the adiabatic compression means for field shaping of the magnetically confined plasma in order to bring the plasma equilibrium close to the threshold for whistler instability.

31. The apparatus of claim 27 further comprising means for withdrawing the relatively intense microwave pulse from the enclosure and focusing means for receiving the withdrawn pulse and concentrating it into a beam of focused radiation.

32. The apparatus of claim 31 wherein the focusing means comprises a quasi-optical structure for receiving the microwave pulse from the enclosure and for transmitting the beam.

33. The apparatus of claim 32 comprising control means for causing the other means in the apparatus to sequentially repeat their operating functions in order to produce a sequential output series of pulses in the beam.

34. Apparatus for producing a pulse of microwave radiation, comprising means for forming a generally stable, high-beta, relativistic-electron plasma magnetically confined in a magnetic mirror region of an enclosure, means for inducing a convectively unstable wave in the confined plasma for producing a pulse of relatively intense microwave radiation at a frequency near a local electron gyrofrequency of the plasma.

means for withdrawing the relatively intense microwave pulse from the enclosure through focusing means for concentrating the pulse into a beam of focused radiation, control means for regulating operation of the other apparatus means in a sequentially repeating manner to produce a beam of sequential pulses, and means for directing the beam of sequential pulses toward a target including electron circuit means, the control means being adapted for regulating operation of the other apparatus means for causing the beam of sequential pulses to be coupled into the electronic circuit means for developing substantial amounts of energy therein.

* * * * *